US008086161B2

(12) United States Patent
Omata

(10) Patent No.: US 8,086,161 B2
(45) Date of Patent: Dec. 27, 2011

(54) IMAGE FORMING APPARATUS WHICH FORMS A TONER IMAGE ON A RECORDING MEDIUM WITH THE USE OF COLOR TONER AND TRANSPARENT TONER

(75) Inventor: Haruhiko Omata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 413 days.

(21) Appl. No.: 12/125,399

(22) Filed: May 22, 2008

(65) Prior Publication Data

US 2008/0298860 A1 Dec. 4, 2008

(30) Foreign Application Priority Data

Jun. 4, 2007 (JP) ..... 2007-147972

(51) Int. Cl.
*G03G 15/20* (2006.01)

(52) U.S. Cl. ..... 399/341
(58) Field of Classification Search ..... 399/321, 399/341
See application file for complete search history.

(56) References Cited

U.S. PATENT DOCUMENTS

| | | | | |
|---|---|---|---|---|
| 5,983,042 | A | 11/1999 | Nagata et al. | |
| 6,112,037 | A | 8/2000 | Nagata et al. | |
| 7,542,707 | B2 | 6/2009 | Omata | |
| 2003/0007814 | A1 | 1/2003 | Richards | |
| 2006/0077197 | A1 | 4/2006 | Lin | |
| 2006/0133870 | A1 * | 6/2006 | Ng et al. | 399/341 |
| 2006/0188295 | A1 | 8/2006 | Kasiske et al. | |
| 2006/0188301 | A1 | 8/2006 | Ng et al. | |
| 2006/0210295 | A1 * | 9/2006 | Nakaya et al. | 399/75 |
| 2006/0275058 | A1 | 12/2006 | Omata | |

FOREIGN PATENT DOCUMENTS

| | | | |
|---|---|---|---|
| JP | 10-123866 | A | 5/1998 |
| JP | 2002-318482 | A | 10/2002 |
| JP | 2006-251772 | A | 9/2006 |
| KR | 2006-125515 | A | 12/2006 |
| RU | 2299457 | C2 | 5/2007 |

OTHER PUBLICATIONS

Korean Office Action dated Apr. 19, 2010, in counterpart Korean Application No. 10-2008-51998.
Decision of Grant—Patent for Invention dated Apr. 16, 2010, in counterpart Russian Application No. 2008122299/28 (026587).
Office Action dated Jul. 27, 2009, in counterpart Russian Application No. 2008122299/(026587) and an English-language translation thereof.
European Search Report dated Aug. 22, 2008 in Japanese Application No. 08157491.5.
Notice of Preliminary Rejection dated Sep. 30, 2009, in counterpart Korean Application No. 10-2008-51998 and an English-language translation thereof.
Notification of the First Office Action dated Oct. 30, 2009, in counterpart Chinese Application No. 200810110359.9 and an English-language translation thereof.

* cited by examiner

*Primary Examiner* — David Gray
*Assistant Examiner* — Billy J Lactaoen
(74) *Attorney, Agent, or Firm* — Fitzpatrick, Cella, Harper & Scinto

(57) ABSTRACT

An image forming apparatus includes a toner image forming unit for effecting an image forming operation to form toner image on a recording material, wherein the toner image comprises chromatic toner image components with different colors and a transparent toner image component overlaid thereon; a fixing unit for effecting a fixing operation to heat and fix the toner image on the recording material; a switching unit for switching, in accordance with information relating to a maximum toner amount per unit area in a zone in which the transparent toner component is present, operations to a mode in which the formation of the toner image is effected through a plurality of such image forming operations, and the fixing of the toner image is effected through a plurality of such fixing operations.

3 Claims, 7 Drawing Sheets

IMAGE FORMING APPARATUS WHICH FORMS A TONER IMAGE ON A RECORDING MEDIUM WITH THE USE OF COLOR TONER AND TRANSPARENT TONER

FIELD OF THE INVENTION AND RELATED ART

The present invention relates to an image forming apparatus which forms a toner image on recording medium with the use of both color toners and a transparent toner.

As image forming apparatuses of the above-mentioned type, there are an electrophotographic copying machine, an electrophotographic printer, an electrophotographic facsimile machine, a multifunction apparatus capable of performing two or more functions of the preceding apparatuses, etc.

In recent years, an electrophotographic apparatus which can be used with clear toner, that is, transparent toner, along with ordinary toners, that is, color toners, has been proposed. Enabling an image forming apparatus to be used with clear toner along with color toners can make the image forming apparatus more versatile in terms of the appearance (expression) of the image it forms, enabling thereby the image forming apparatus to yield copies (prints) which are higher in value.

One of the reasons for using clear toner is to yield a print (copy) having a glossy image, a print (copy) which is entirely uniform in glossiness across its image formation area. It is preferable that a print (copy) is uniform in glossiness across the entirety of the image formation area of its recording medium. Further, in the case of a photographic print (copy), it seems that the higher a print is in glossiness, the better it is perceived to be.

However, an ordinary electrophotographic image forming apparatus is likely to yield a print which is not uniform in glossiness. More specifically, the white (background) areas of a print are not covered with toner. Thus, the glossiness of the white (background) portion of a print is equal to the surface glossiness of recording medium, such as a sheet of paper, being therefore always the same. On the other hand, the so-called highlight portion of the image of a print is made up of the multiple fine dots which are formed of toner, on the recording medium, in the pattern of a fine screen, being therefore not smooth in surface. Therefore, the so-called highlight portion of the image of a print formed by an electrophotographic image forming apparatus is not as glossy as the white (background) portion of the same image. Further, the solid color (or black) portion of the image of a print is the portion of recording medium (recording paper), which is entirely covered with toner, being therefore smooth across its surface. Therefore, the solid color (or black) portion of the image of a print is glossier. This is why a print image formed by an electrophotographic image forming apparatus is nonuniform in glossiness in entirety, being therefore not as high in quality as desired.

Therefore, in order to yield a print uniform across its entire surface, that is, a print, the white (background) portion of which is the same in glossiness as the solid color (or black) portion of the image of the print, it has been thought of covering the entire surface of the image formation portion of the print before fixing the image. Further, if it is wanted to yield a highly glossy print, it is possible to increase the amount by which heat is given to recording medium, such as a sheet of paper, to fully melt the toner, or use a clear toner which is lower in viscosity when it is in the melted state.

As for another benefit of the usage of clear toner, clear toner can be used to form an inconspicuous marking (image), such as a watermark, an eye-catch, a security mark, etc. Clear toner can be used to form inconspicuous markings (images) different in glossiness level. It is desired that the level of inconspicuousness with which an image is formed of clear toner is optional; the level of inconspicuousness can be controlled by a user.

Japanese Laid-open Patent Application 2002-318482 discloses the following image forming method which uses clear toner along with ordinary toner. That is, first, a full-color toner image is formed on recording medium using four color toners different in color, and then, is fixed. Then, a clear toner image is formed on this recording medium by conveying again the recording medium through the image forming portion. Then, the clear toner image is fixed.

The image forming method disclosed in the above-mentioned patent application has a merit in that in spite of the usage of the four color toners, different in color, and one clear toner, the toners can be properly fixed without increasing the fixing device in performance.

However, the employment of the image forming method proposed in Japanese Laid-open Patent Application 2002-318482 caused the following problems.

That is, in the case of the image forming method proposed in Japanese Laid-open Patent Application 2002-318482, even when the amount of toner deposited on recording medium to form the color toner image, which will be under the clear toner image, is rather small, each print (copy) was produced by carrying out twice the combination of the toner image forming (transferring) process and toner image fixing process.

In other words, in the case of the image forming method disclosed in Patent Document 1, regardless of the amount by which color toners are deposited on recording medium to form a color toner image, that is, the image which will be under the clear toner image, the combination of the toner image forming (transferring) process and toner image fixing process is carried out twice to yield a single print.

In other words, even when the color toners and clear toner can be fixed all at once in consideration of the performance of the fixing apparatus, the combination of the toner image transferring process and toner image fixing process is carried out twice to yield a single print, unnecessarily increasing the length of time from the starting of an image forming operation to the discharging of recording medium from the image forming apparatus.

SUMMARY OF THE INVENTION

The primary object of the present invention is to provide an image forming apparatus which does not suffer from problems, such as those described above.

That is, the primary object of the present invention is to provide an image forming apparatus which is not unnecessary long in the length of time necessary to form an image with the use of both color toners and transparent toner.

According to an aspect of the present invention, there is provided an image forming apparatus comprising a toner image forming unit for effecting an image forming operation to form a toner image on a recording material, wherein the toner image comprises chromatic toner image components with different colors and a transparent toner image component overlaid thereon; a fixing unit for effecting a fixing operation to heat and fix the toner image on the recording material; a switching unit for switching, in accordance with information relating to a maximum toner amount per unit area in a zone in which the transparent toner component is present, operations to a mode in which the formation of the toner image is effected through a plurality of such image forming operations, and the fixing of the toner image is effected through a plurality of such fixing operations.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(1) Image Forming Portion

Figure 1:
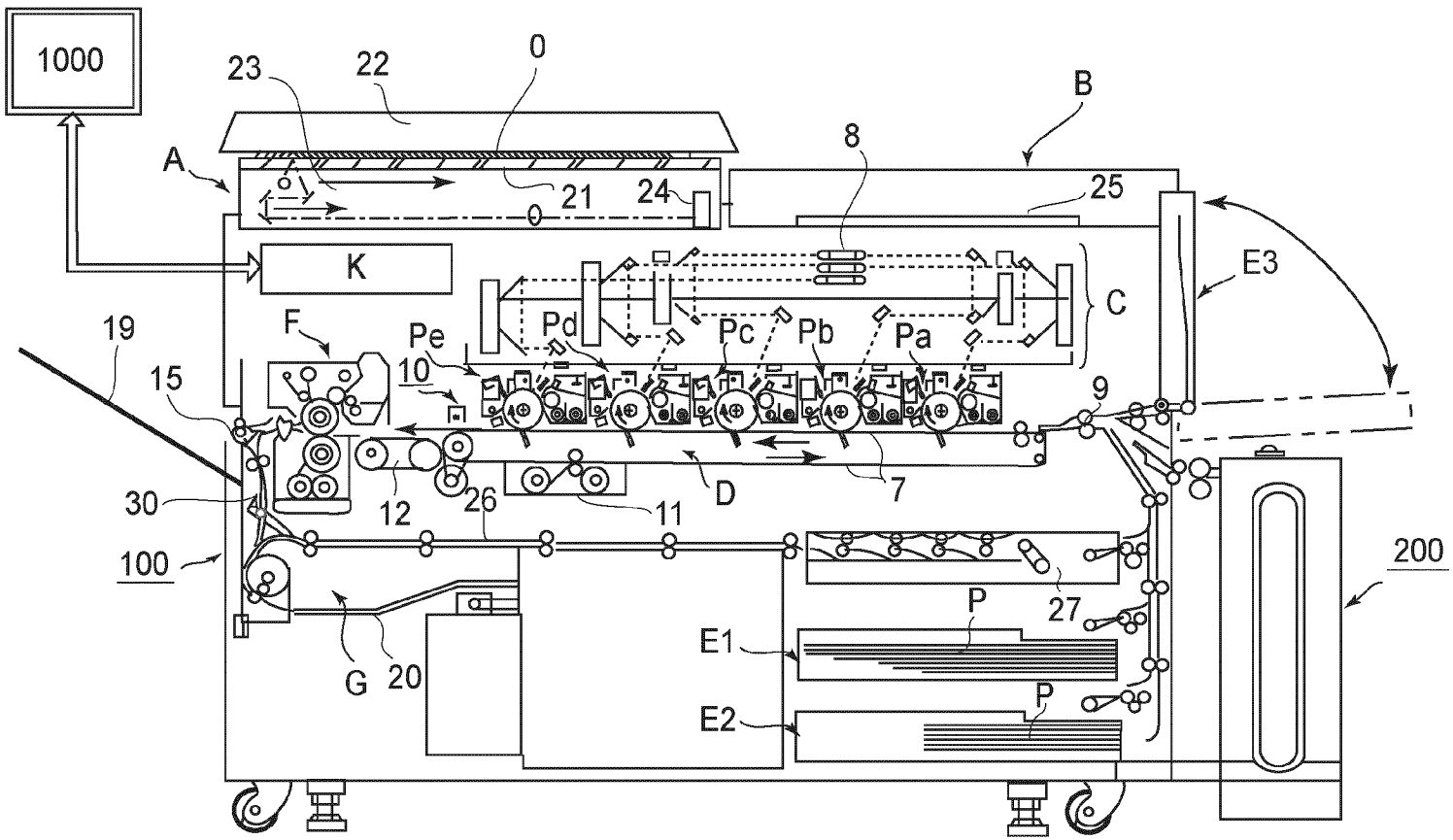
FIG. 1 is a schematic sectional view of the image forming apparatus in the first embodiment of the present invention, showing the general structure of the apparatus.
Figure 2:
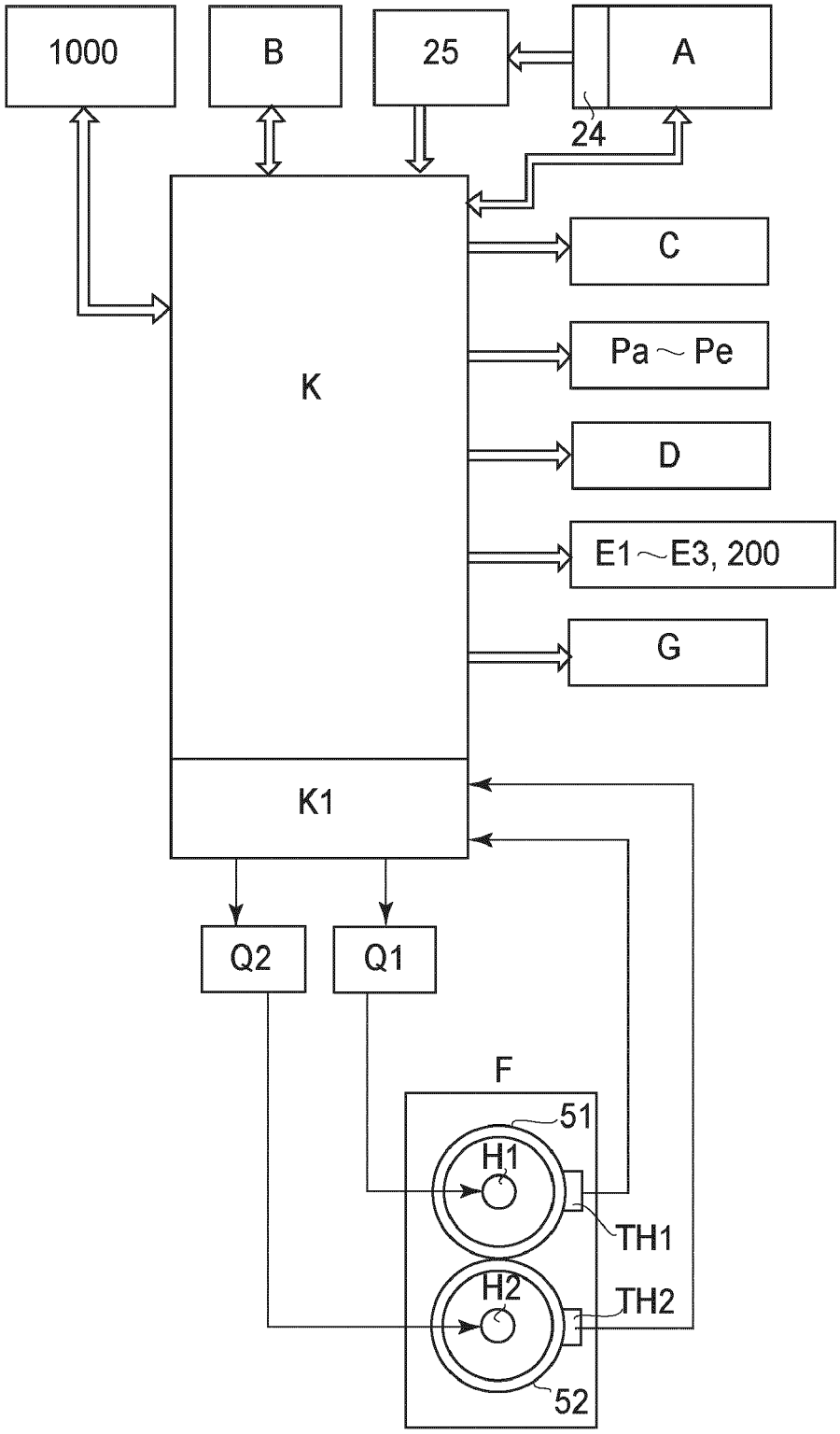
FIG. 2 is a block diagram of the control system of the image forming apparatus shown in FIG. 1.

FIG. 1 is a schematic sectional view of the image forming apparatus (recording apparatus) in this embodiment of the present invention, and shows the general structure of the apparatus. FIG. 2 is a block diagram of the control system of the image forming apparatus in this embodiment. The image forming apparatus in this embodiment is an electrophotographic full-color image forming apparatus. It is a multifunction image forming apparatus, being capable of functioning as a copying machine, a printer, and a facsimile machine. It employs five photosensitive drums disposed in tandem.

First, its image forming portions will be described. Designated by a reference number 100 is the main assembly of the image forming apparatus (which hereafter will be referred to simply as apparatus main assembly). Designated by a reference number 200 is a paper feeder unit of a large capacity, which is directly in connection with the apparatus main assembly 100. This large capacity paper feeder unit 200 is structured as an optional peripheral apparatus usable in combination with the apparatus main assembly 100.

Designated by a reference letter K is a controller (control circuit, controlling means) which controls the overall operation of the image forming apparatus. Designated by a reference number 1,000 is an external apparatus (external host apparatus), such as a personal computer or facsimile machine, from which the information regarding an image to be formed is inputted into the apparatus main assembly 100. The external apparatus 1,000 is in electrical connection to the controller K through an interface.

Referring to FIG. 1, the apparatus main assembly 100 has first to fifth electrophotographic image forming portions Pa, Pb, Pc, Pd, and Pe, respectively, which are disposed in tandem in the horizontal direction from left to right in the top side of the apparatus main assembly 100. Designated by reference letters A and B are an original reading portion (image scanner) and a control panel-display portion, respectively, which make up the top portion of the apparatus main assembly 100. The original reading portion A reads an original O placed on the glass platen 21 (original holding glass plate). More specifically, it optically scans the original O, and separates the optical image of the original into multiple monochromatic images of primary colors, one for one. The control panel-display portion B is the portion to be used by an operator to input a command, or for informing an operator of the condition of the image forming apparatus, etc.

Designated by a reference letter C is a scanning system based on laser (laser scanner), which has multiple optical scanning means. The laser scanner C is on the top side of the group of the above-mentioned first to fifth image forming portions Pa, Pb, Pc, Pd, and Pe. It functions as an image forming means. Designated by a reference letter D is a transfer belt system, which is on the bottom side of the group of the first to fifth image forming portions Pa, Pb, Pc, Pd, and Pe. Designated by reference alphanumeric symbols E1 and E2 are first and second paper feeder cassettes (paper feeding portions employing paper feeder cassettes, one for one), which are vertically stacked on the bottom side of the transfer belt system D. Designated by a reference alphanumeric symbol E3 is a manual paper feeder tray (manual paper feeding portion), which can be folded up into the position outlined by a solid line when it is not in use, or opened down into the position outlined by a dotted line. Designated by a reference letter F is a fixing apparatus, which is on the downstream side of the transfer belt system D, in terms of the recording medium conveyance direction.

Regarding the original reading portion A, designated by a reference number 21 is an original placement glass platen, and designated by a reference number 22 is an original pressing plate which can be opened or closed relative to the original placement glass platen 21. When the image forming apparatus is in the copy mode (original copying mode), a full-color original O (also, monochromatic or black-and-white original), that is, an image to be copied, is to be placed on the glass platen 21, following the preset original placement requirements, with the image bearing surface of the original O facing downward. Then, the original O is to be covered with the original pressing plate 22. The original pressing plate 22 may be replaced with an automatic original feeding apparatus (ADF, RDF) so that an original in the form of a sheet can be automatically fed onto the glass plate 21 of the original reading portion A. Next, desired copying conditions are to be set by a user (operator) with the use of the control panel-display portion B. Then, the copy start key 400 (FIG. 3) is to be pressed. As the key 400 is pressed, a movable optical system 23 is activated and moved along the bottom surface of the glass platen 21, optically scanning the downwardly facing surface, that is, image bearing surface, of the original O on the glass platen 21. As the image bearing surface of the original O is scanned by the beam of light projected by the original reading portion A, the portion of the beam of light, which is reflected by the image bearing surface, is focused on the CCD 24, which is a photoelectric transducer (picture taking solid-state element). The CCD 24 separates the reflected beam of light into three beams of light, which are R, G, B (red, green, and blue) in color, and outputs electrical signals which correspond to red, green, and blue beams of light. These electrical signals are inputted into the image processing portion 25 of the apparatus main assembly 100, which processes the electrical signals into electrical pictorial information which corresponds to the colors (C, M, Y, and K) of the color toners used by the image forming apparatus. This electrical pictorial information is inputted into the controller K, which controls the laser scanning system C so that the laser scanning system C outputs a beam of laser light, while modulating it with the electrical pictorial signals, onto the electrophotographic photosensitive drums in the first to fifth image forming portions Pa, Pb, Pc, Pd, and Pe, respectively.

When the image forming apparatus is in the printer mode, it is from the external host apparatus 1,000, such as a personal computer, that electrical pictorial information is inputted into the controller K of the apparatus main assembly 100, causing thereby the image forming apparatus to function as a printer.

When the image forming apparatus is in the facsimile reception mode, it is from the facsimile apparatus on the facsimile transmitting side, that is, the external host apparatus 1,000, that the electrical pictorial information is inputted into the controller K of the apparatus main assembly 100, causing thereby the image forming apparatus to function as a facsimile receiving apparatus.

When the image forming apparatus is in the facsimile transmitting mode, the electrical pictorial information of the original, which is obtained by the original reading portion A, which photoelectrically reads the original, is inputted into the controller K from the image processing portion 25. Then, the controller K causes the image forming apparatus to function as a facsimile transmitting apparatus, which transmits the electrical pictorial signals to the facsimile apparatus on the receiving side.

Figure 3:
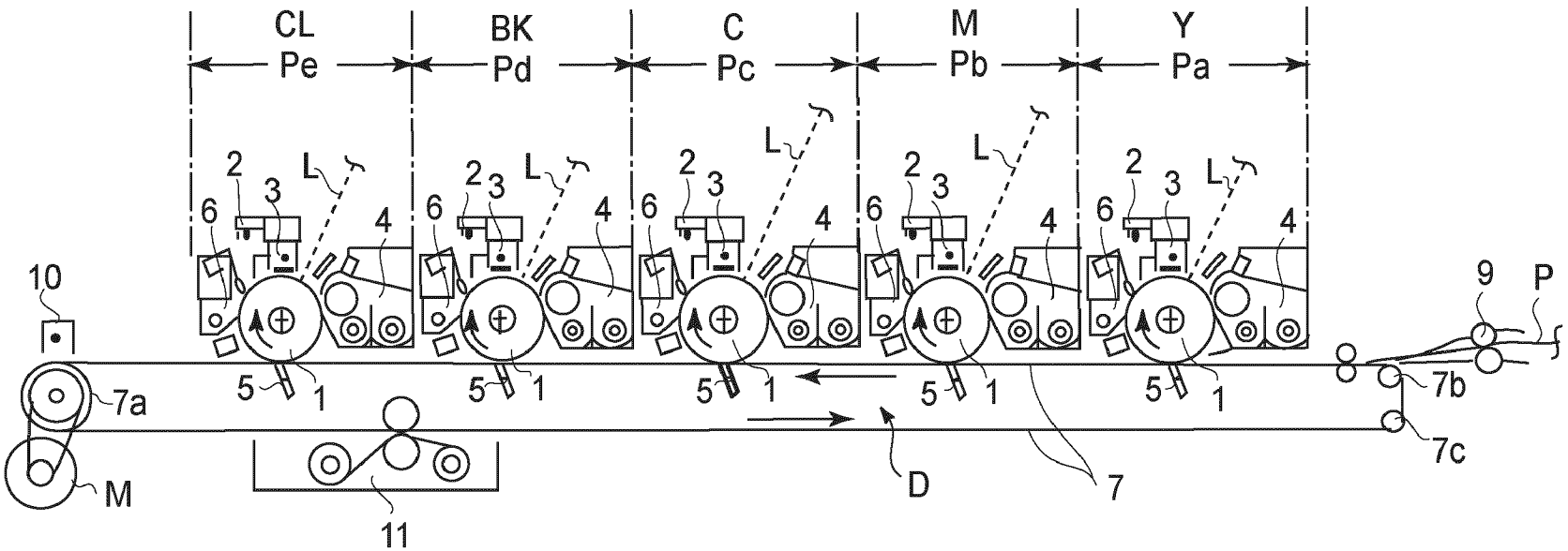
FIG. 3 is an enlarged view of a part of FIG. 1.

FIG. 3 is an enlarged schematic sectional view of the combination of the group of first to fifth image forming portions Pa, Pb, Pc, Pd, and Pe, and the transfer belt system D. The first to fifth image forming portions Pa, Pb, Pc, Pd, and Pe are electrophotographic, and are the same in image forming process.

In this embodiment, the image forming portions Pa, Pb, Pc, and Pd use color toners Y, M, C, and K, respectively. They make up a first image forming means which sequentially forms four color toner images, different in color, and sequentially places it on the color toner images on recording medium. The image forming portion Pe makes up a second image forming means which forms a toner image of transparent toner, and places the transparent toner image on the layered color toner images on the recording medium.

More specifically, each image forming portion has an electrophotographic photosensitive drum 1 (which hereafter will be referred to simply as drum) as an image bearing member. It also has multiple processing means, that is, a full exposure lamp 2 (charge removal lamp), a primary charging device 3, a developing device 4, a transfer charging device 5, and a drum cleaner 6, etc., which process the drum 1. To the developing device 4 of the first image forming portion Pa, yellow (Y) color toner (developer) is supplied by a toner supplying apparatus. To the developing device 4 of the second image forming portion Pb, magenta (M) color toner (developer) is supplied by a toner supplying apparatus. To the developing device 4 of the third image forming portion Pc, cyan (C) color toner (developer) is supplied by a toner supplying apparatus. To the developing device 4 of the fourth image forming portion Pd, black (Bk) toner (developer) is supplied by a toner supplying apparatus. To the developing device 4 of the fifth image forming portion Pe, clear toner T (developer: transparent developer) is supplied by a toner supplying apparatus.

The transfer belt system D which functions as a part of the image forming means has an endless transfer belt 7, a driver roller 7*a*, a turn roller 7*b*, and a turn roller 7*c*. The transfer belt 7 is suspended and stretched by the rollers 7*a*, 7*b*, and 7*c*. As the driver roller 7*a* is rotationally driven by a motor M through a driving force transmitting apparatus, such as a timing belt, the transfer belt 7 is circularly moved in the counterclockwise direction at a preset velocity. The transfer belt 7 is formed of a dielectric resin sheet, such as a polyethylene-terephthalate resin sheet (PET resin sheet), polyfluorovinylidene resin sheet, polyurethane resin sheet, or the like. It is formed by bonding in layers the lengthwise end portions of along and narrow sheet of one of the above-mentioned resins, or is formed as a seamless belt.

A clear toner usage mode, which will be described later in detail, is an image formation mode for outputting a glossy copy (glossy full-color copy, glossy monochromatic copy, glossy black-and-white copy) with the use of both color toner(s) and clear toner.

A clear toner free mode, which also will be described next in detail, is an image formation mode for forming an ordinary copy (ordinary full-color copy, ordinary monochromatic copy, ordinary black-and-white copy) with the use of only color toner(s), that is, without using clear toner.

First, the full-color image forming operation in the clear toner free mode, that is, the image forming operation for forming a full-color image without using clear toner, will be described. The full-color image forming operation in the clear toner free mode, that is, the image forming operation for forming a glossy full-color image with the use of both the color toner(s) and clear toner, will be described later in detail in Section (4).

In the clear toner free mode, an image is formed with the use of the first to fourth image forming portions Pa, Pb, Pc, and Pd among the first to fifth image forming portions Pa, Pb, Pc, Pd, and Pe. In the fifth image forming portion Pe, the drum 1 is rotated, but, no clear toner image is formed.

More specifically, the first to fifth image forming portions Pa, Pb, Pc, Pd, and Pe sequentially begin to be driven with preset control timing. As they begin to be driven, the drum 1 in each image forming portion rotates in the clockwise direction indicated by an arrow mark, and also, the transfer belt 7 of the transfer belt system D begins to be circularly driven. Further, the laser scanning system C begins to be driven. In synchronism with the driving of these components, the primary charging device 3 in each of the first to fourth image forming portions Pa, Pb, Pc, and Pd uniformly charges the corresponding drum 1 to preset polarity and potential level. The laser scanning system C scans (exposes) the peripheral surface of the drum 1 in each of the first to fourth image forming portions Pa, Pb, Pc, and Pd, with the beam of laser light L which it emits, while modulating the beam of laser light L with pictorial signals, effecting thereby an electrostatic image, which reflects the pictorial signal, on the peripheral surface of the drum 1 of each of the first to fourth image forming portions Pa, Pb, Pc, and Pd. More specifically, the laser scanning system C emits the beam of laser light L from its light source. The beam of laser light L is reflected by a polygon mirror 8, which is being rotated. The reflected beam of laser light L is focused on the peripheral surface of the drum 1, by an f-θ lens while being moved in the direction parallel with the generatrix of the drum 1 in a manner to scan the peripheral surface of the drum 1. As a result, an electrostatic image, which reflects the pictorial signals, is effected on the peripheral surface of the drum 1. The electrostatic image is developed into a visible image, that is, an image formed of toner (which hereafter will referred to simply as toner image), by the developing device 4.

Through an electrophotographic process, such as the above-described one, a yellow (Y) toner image, which corresponds to the yellow component of the full-color image, is formed on the peripheral surface of the drum 1 of the first image forming portion Pa, and a magenta (M) toner image, which corresponds to the magenta component of the full-color image, is formed on the peripheral surface of the drum 1 of the second image forming portion Pb. Further, a cyan (C) toner image, which corresponds to the cyan component of the full-color image, is formed on the peripheral surface of the drum 1 of the third image forming portion Pc, and a black (Bk) toner image, which corresponds to the black component of the full-color image, is formed on the peripheral surface of the drum 1 of the fourth image forming portion Pd. However, no image (clear toner image) is formed on the peripheral surface of the drum 1 of the fifth image forming portion Pe, although the drum 1 in the fifth image forming portion Pe is rotated.

Meanwhile, one among the four paper feeding portions, that is, the large capacity paper feeding apparatus 200, first paper feeder cassette E1, second paper feeder cassette E3, and manual paper feeder tray E3 is selected by a user (operator), and the paper feeder roller of the selected paper feeding portion, is driven. As the paper feeder roller is driven, the recording mediums P having been stored in layers in the selected paper feeding portion are fed into the apparatus main assembly 100 while being separated one by one. Then, each recording medium P is delivered to the outward surface of the endless transfer belt 7 of the transfer belt system D by the multiple paper conveyance rollers, and a pair of registration rollers 9. As the recording medium P is delivered to the transfer belt 7, it is conveyed to the five transferring portions of the first to fifth image forming portions Pa, Pb, Pc, Pd, and Pe, respectively, in the listed order. The transfer portion is the area of contact between the drum 1 and transfer belt 7 in each image forming portion.

More specifically, as the transfer belt 7 is circularly driven, it is checked whether or not a reference point of the transfer belt 7 is in the preset position. The moment it is detected that the reference point of the transfer belt 7 is in the present position, the recording medium P, which has been kept on standby by the pair of registration rollers 9, is released by the registration rollers 9, and is conveyed to the transfer portion of the first image forming portion Pa. At the same time, an image writing start signal is inputted, causing the first image forming portion Pa to form an image on its drum 1 with a preset control timing. Then, the transfer charging device 5 generates an electric field in the transfer portion, which is the contact area between the downwardly facing portion of the peripheral surface of the drum 1 and the transfer belt 7, or gives electrical charge to the transfer belt 7. As a result, the image formed on the drum 1 of the first image forming portion Pa, that is, a toner image of yellow color (first color), is transferred onto the recording medium P. With the generation of the electric field or the giving of electric charge to the transfer belt 7, the recording medium P is firmly held to the transfer belt 7 by the electrostatic force, and then, is sequentially conveyed through the transfer portions of the second to fourth image forming portions Pb, Pc, and Pd, in the listed order. While the recording medium P is conveyed through the transfer portions of the second to fourth image forming portions Pb, Pc, and Pd, a magenta (M) toner image, a cyan (C) toner image, and a black (Bk) toner image, which are formed in the second to fourth image forming portions Pb, Pc, and Pd, respectively, are sequentially transferred in layers onto the yellow (Y) toner image on the recording medium P. As a result, an unfixed full-color image is synthetically effected by four monochromatic toner images, that is, yellow (Y), magenta (M), cyan (C), and black (Bk) toner images, on the recording medium P. In this mode, however, the fifth image forming portion Pe does not form an image (clear toner image), although its drum 1 is rotated. Therefore, it does not occur that a clear toner image is transferred onto the recording medium P in the transfer portion of the fifth image forming portion Pe.

The transfer charging device 5 in this embodiment is a charging device of the contact type. It has been known that when the electric current, which is provided by a transfer charging means and contributes to image transfer, is kept stable at a proper level, an image forming apparatus remains stable in terms of image quality. Thus, it is common practice to control the transfer charging means so that the electric current provided by the transfer charging means remains constant regardless of the volume resistivity of recording medium, because the volume resistivity of recording medium is affected by various factors, such as the change in the material for the recording medium, change in the thickness of recording medium, change in humidity, etc.

After a full-color toner image is synthetically formation on the recording medium P by the four monochromatic toner images different in color, electrical charge is removed from the recording medium P by the separation charging device 10, which is at the downstream end of the transfer belt 7 in terms of the recording medium conveyance direction. As a result, the electrostatic force which has kept the recording medium P adhered to the transfer belt 7 is reduced, allowing thereby the recording medium P to separate from the transfer belt 7 at the downstream end of the transfer belt 7. Incidentally, the following should be specifically noted: In an ambience in which humidity is low, the recording medium P dries, reducing therefore in electrical resistance. As a result, the electrostatic force which keeps the recording medium P adhered to the transfer belt 7 increases, making thereby the role of the separation charging device 10 more important. Normally, the separation charging device 10 charges the recording medium P before the toner image(s) are fixed. Therefore, a charging device of the noncontact type is employed as the separation charging device 10. Designated by a reference number 11 is a cleaning apparatus for cleaning the surface of the transfer belt 7.

Figure 5:
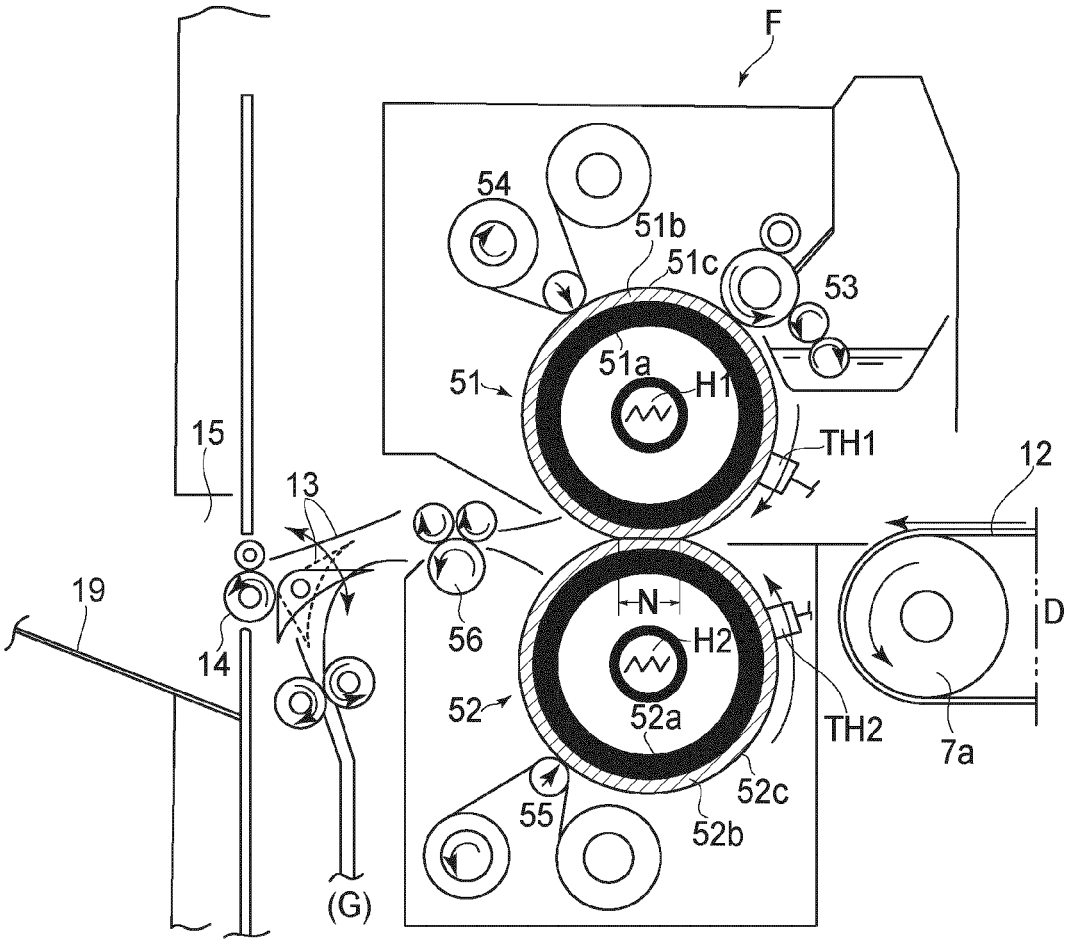
FIG. 5 is an enlarged sectional view of the fixing apparatus of the image forming apparatus in the first embodiment, which uses a pair of heat rollers.

After being separated from the transfer belt 7, the recording medium P is introduced by a conveyer belt 12 into the fixing apparatus F, which is a fixing means for thermally fixing the unfixed toner image(s) formed on the recording medium P to the surface of the recording medium P. Referring to FIG. 5, the fixing apparatus F in this embodiment is a fixing apparatus which employs a pair of heating rollers. This fixing apparatus F, which employs the heating rollers, will be described in detail later in Section (3). As the recording medium P is introduced into the fixing apparatus F, it is advanced into a fixation nip N, that is, a compression nip, which is the area of contact between the fixation roller 51 and pressure roller 52 of the fixing apparatus F. Then, it is conveyed through the fixation nip N while remaining pinched by the fixation roller 51 and pressure roller 52. As a result, the recording medium P and the toner images, different in color, on the recording medium, are subjected to heat and pressure, being thereby fixed to the recording medium P while being mixed. After being moved through the fixation nip N, the recording medium P is conveyed further by the set of discharge rollers 56 of the fixing apparatus F to be discharged from the apparatus main assembly 100. More specifically, the recording medium P is conveyed on the top side of a selector 13, which will have been moved into the first position outlined by a solid line in FIG. 5, is relayed by the pair of discharge rollers 14 of the apparatus main assembly 100, and then, is discharged into an external delivery tray 19 through the opening of the recording medium outlet 15.

When the image forming apparatus is in the two-sided image formation mode, the path of the recording medium P is as follows: After an image is formed on one of the two surfaces of the recording medium P, and the image is fixed by the fixing apparatus F, the recording medium P is directed by the selector 13, which has been moved into its second position outlined by a two-dot chain line in FIG. 5, toward a sheet conveying system G, which turns over the recording medium P and refeeds the recording medium P into the apparatus main assembly 100. Then, while the recording medium P is conveyed through the paper turning-and-refeeding system G, it is turned over by the paper turning portion (switchback portion) of the system G, and then, is conveyed to a recording medium conveyance path 26 for two-sided image formation. Then, the recording medium P is temporarily stored in an intermediary tray 27. Then, the recording medium P is sent out from the intermediary tray 27 toward the pair of registration rollers 9 by a paper feeder roller which is driven with preset control timing. Then, it is released by the registration rollers 9, and is conveyed onto the transfer belt 7 of the transfer belt system D for the second time, with its second surface facing upward. Then, it is conveyed through the first to fourth image forming stations Pa, Pb, Pc, and Pd to synthetically form a full-color image of the four monochromatic toner images, different in color, as it was when a full-color image was formed on the first surface of the recording medium P. After the synthetic formation of the full-color toner image on the second surface of the recording medium P, the recording medium P is separated from the transfer belt 7, and is conveyed to the fixing apparatus F, in which the four monochromatic toner images, which make up the full-color toner image, are fixed to the second surface of the recording medium P.

The image forming apparatus in this embodiment is capable of outputting a monochromatic color toner image as well as a black-and-white image. If the monochromatic mode (including black-and-white mode) is selected, only the image forming portion, among the first to fifth image forming portions Pa, Pb, Pc, Pd, and Pe, which corresponds to the selected color (including black), is operated for image formation. The rest of the image forming portions is not operated for image formation, although their drums 1 are rotationally driven. The image formed in the image forming portion which corresponds to the selected color is transferred onto the recording medium P, which is conveyed by the transfer belt system D, in the transfer portion of this image forming portion, in which the sequence for transferring a toner image onto the recording medium P is carried out.

(2) Control Panel-Display Portion B

Figure 4:
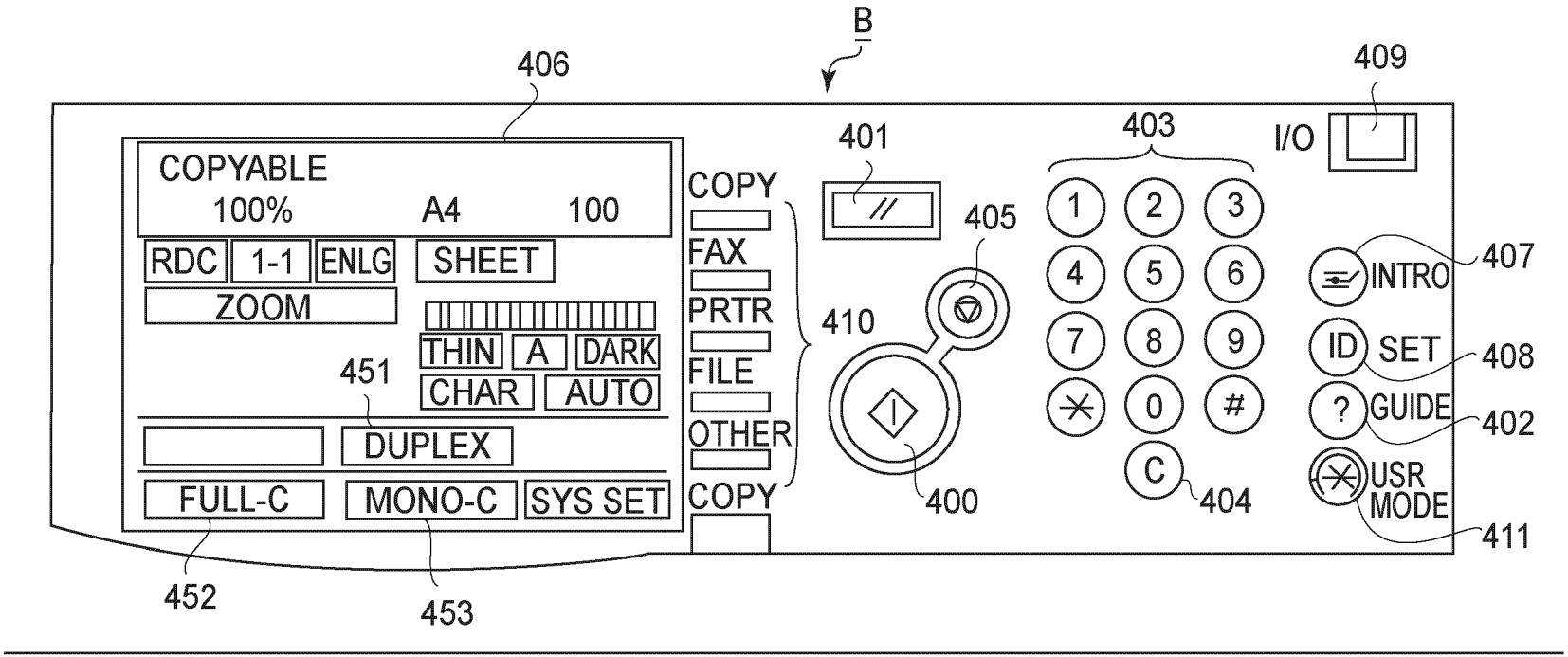
FIG. 4 is a plan view of the control panel-display combination of the image forming apparatus in the first embodiment.

FIG. 4 is a plan view of the control panel-display portion B. Designated by a reference number 400 is a copy start key for starting a copying operation. Designated by a reference number 401 is a reset key for resetting the image forming apparatus to the normal mode, which in this embodiment is the single-sided, black-and-white, and clear toner free mode. Designated by a reference number 402 is a help key, which is to be pressed when it is necessary to use the help function. Designated by a reference number 403 is a group of numerical keys to be used to input a numerical value, such as the number of copies to be made. Designated by a reference number 404 is a clear key for clearing the inputted numerical value. Designated by a reference number 405 is a stop key for interrupting a copying operation which is being carried out. Designated by a reference number 406 is a liquid crystal display which displays the various operational modes, printer conditions, etc., and also, functions as a touch panel for selecting (inputting) various settings. Designated by a reference number 407 is an interruption key for suspending an ongoing copying operation, faxing operation, or printing operation to output an urgently needed copy or the like. Designated by a reference number 408 is a password key for controlling the copy count for each user, each section, or the like. Designated by a reference number 409 is a soft switch for turning on or off the electrical power source of the apparatus main assembly 100. Designated by a reference number 410 is a function selection key for switching the function of the image forming apparatus. Designated by a reference number 411 is a user mode key for placing the image forming apparatus into the user mode to enable a user to input optional settings, such as turning on or off the automatic cassette changing function, changing the length of time which is allowed to elapse before the image forming apparatus is placed in the energy saving mode, etc. Designated by a reference number 451 is the two-sided image formation mode selection key. Designated by a reference number 452 is the full-color image formation mode selection key. Designated by a reference number 453 is the black-and-white image formation mode selection key.

(3) Fixing Apparatus F

Next, referring to FIG. 5, the fixing apparatus F, which employs heat rollers, will be described in more detail. Designated by reference numbers 51 and 52 are a fixation roller (fixing member) and a pressure roller (pressing member), respectively. The two rollers 51 and 52 are supported by bearings, being therefore rotatable. They are arranged in such a manner that their axial lines are horizontal and are parallel to each other. Further, they are kept pressed against each other, forming thereby the fixing nip N (area of contact between the two rollers).

The fixation roller 51 is made up of concentric three portions, that is, a core portion 51*a*, an elastic layer 51*b*, and a release layer 51*c*. The core portion 51*a* is a piece of hollow aluminum tube, which is 44 mm in diameter and 5 mm in thickness. The elastic layer 51*b* is formed of silicon rubber, which is 50 degrees in hardness (JIS-A hardness scale), and 2.5 mm in thickness. The release layer 51*c* is formed of PFA, and is 50 μm in thickness. There is a halogen lamp H1, that is, the heat source (roller heating heater), in the hollow of the core portion 51*a*.

The pressure roller 52 also is made up of concentric three portions, that is, a core portion 52*a*, an elastic layer 52*b*, and a release layer 52*c*, as is the above-described fixation roller 51. However, the elastic layer 52*b*, which also is formed of silicon rubber, is 3mm in thickness, in order to earn a greater width for the fixation nip N. Designated by a reference alphanumeric symbol H2 is a halogen lamp, which is placed, as a heat source (roller heating heater), in the hollow of the core portion 52*a* of the pressure roller 52.

The fixation roller 51 and pressure roller 52 are kept pressed against each other by the application of a preset amount of pressure, forming thereby the fixation nip N, that is, the portion for applying heat and pressure to the recording medium and the toner image(s) thereon. The fixation nip N has a preset width in terms of the recording medium conveyance direction. In this embodiment, the total amount of pressure applied to the pressure roller 52 to keep the two rollers 51 and 52 pressed against each other was 294 N (30 kgf), and the above-mentioned width of the fixation nip N was 7 mm.

The fixation roller 51 and pressure roller 52 are rotationally driven by a motor (not shown) in the direction indicated by arrow marks, one for one, while remaining pressed against each other. The heaters H1 and H2 generate heat by being supplied with electric power by electric power source circuits Q1 and Q2 (FIG. 2), respectively. The fixation roller 51 and pressure roller 52 are heated from within by the heat generated by the heaters H1 and H2, respectively. The power ratings of the heaters H1 and H2 are 800 W and 500 W, respectively.

The surface temperatures of the fixation roller 51 and pressure roller 52 are monitored by temperature sensors TH1 and TH2, which are thermistors or the like placed in contact with the surfaces of the heaters H1 and H2, respectively. The electrical information of the detected temperatures is inputted into the fixation control portion K1 of the controller K. The fixation control portion K1 controls the amount of electric power supplied from the electric power source circuits Q1 and Q2 to the heaters H1 and H2, based on the inputted information, so that the surface temperatures (fixation temperatures) of the fixation roller 51 and pressure roller 52 are maintained at preset control temperature levels (target temperature levels). That is, the fixation roller 51 and pressure roller 52 are controlled to control the temperature of the fixation nip N.

Designated by a reference number 53 is a releasing agent applying apparatus for coating the surface of the fixation roller 51 with a releasing agent, such as dimethyl silicone oil. Designated by a reference number 54 is a cleaning apparatus which employs a piece of web to wipe clean the surface of the fixation roller 51. Designated by a reference number 55 is a cleaning apparatus which also employs a piece of web to wipe clean the surface of the pressure roller 52. The web is a heat resistant woven fabric.

The fixation roller 51 and pressure roller 52 are rotationally driven, and are heated from within by the heaters H1 and H2 so that their surface temperatures are increased to preset control temperature levels and maintained at the preset control temperature levels. While the fixing apparatus F is controlled so that the surface temperatures of the fixation roller 51 and 52 remain at the preset levels, the recording medium P, on which unfixed toner image or images have been formed are introduced into the fixing apparatus F by the conveyer belt 12 from the direction of the transfer belt system D. Then, the recording medium P is conveyed through the fixation nip N while remaining pinched by the fixation roller 51 and pressure roller 52. While the recording medium P is conveyed through the fixation nip N, the recording medium P and the toner image(s) thereon are heated and pressed by the two rollers 51 and 52. As a result, the layered yellow, magenta, cyan, and black monochromatic toner images, which make up a single full-color image, are fixed to the surface of the recording medium P while being mixed. After the recording medium P comes out of the fixation nip N, it is separated from the fixation roller 51 or pressure roller 52 by an unshown separation claw, is relayed by the discharge rollers 56 of the fixing apparatus F, and then, is discharged from the fixing apparatus F.

The releasing agent applying apparatus 53 applies silicone oil to the surface of the fixation roller 51 to prevent the toner from adhering to the surface of the fixation roller 51 while the recording medium P passes through the fixation nip N. The cleaning apparatuses 54 and 55 remove the toner particles having offset onto the surfaces of the fixation roller 51 and pressure roller 52, respectively.

At this time, the toners used in this embodiment will be described. The toners used in this embodiment are made up of polyester resin. The toners may be manufactured by pulverization. However, suspension polymerization, interfacial polymerization, dispersion polymerization, or the like, that is, the toner manufacturing methods which directly yield toner in a medium, is preferable. The ingredients and method for producing toners compatible with the present invention do not need to be limited to those in this embodiment.

The method for manufacturing the clear toner used in this embodiment is similar to that used for manufacturing the color toners in this embodiment. That is, the clear toner in this embodiment is also made up of polyester resin, as is the color toners, although it does not contain coloring pigment. The glass transition point (Tg) of the clear toner does not need to be limited to those given below. The glass transition point (Tg) of the clear toner is affected by the difference in the material for the clear toner and the molecular weight of the material for the clear toner. Thus, even if the fixation condition remains the same, the achievable level of glossiness is affected by the difference among the materials for the clear toner and the molecular weights of the materials for the clear toner; various levels of glossiness can be achieved by varying the material for the clear toner and the molecular weight of the material for the clear toner.

Therefore, a polyester resin which is lower in glass transition point (Tg), that is, easier to melt, than a polyester resin used as the material for the color toners, can be used as the material for the clear toner so that the clear toner can be used as a toner which is glossier after fixation than the color toners. Instead, a polyester resin which is higher in glass transition point (Tg), that is, more difficult to melt, than a polyester resin used as the material for the color toners, can be used as the material for the clear toner so that the clear toner can be used as a toner which is less glossy after fixation than the color toners.

Incidentally, regarding the degree of transparency of the clear toner, all that is necessary is that the clear toner is virtually transparent after fixation, or transparent enough to be virtually transparent after fixation. Before fixation, the clear toner used in this embodiment appears white for the following reason. That is, the clear toner in this embodiment has been pulverized so that it would be 5-10 μm in particle diameter. Thus, light is diffused by the surface of the body of the clear toner in this embodiment. In other words, the clear toner in this embodiment is very low in the amount of light transmission and light absorption, appearing therefore white. Thus, if the amount of thermal energy given to clear toner in the fixation process is small, it is possible that the clear toner does not become completely transparent, and therefore, will appear whitish. Even if the clear toner did not become completely transparent, as long as the target level of glossiness has been achieved, and the clear toner does not separates from the recording medium P, it may be said that the yielded copy (glossy copy) is satisfactory in quality.

Next, the amount of image data will be described. A term "amount of image data" used in the description of the present invention means the amount of data, per picture element, of the pictorial information, in terms of C, M, Y, and K toners, which are obtained by processing the optical monochromatic images of the primary colors, to which the optical image of an original (intended image) are separated. The maximum amount of image data per color toner will be expressed as 100%. The amount of each toner to be deposited on (adhered to) the peripheral surface of the drum 1 (or recording medium) is calculated based on the amount of image data, which is in the range of 0-100%.

A term "amount of toner" here means the amount of toner deposited per picture element on the recording medium. The amount of toner also is expressed in percentage (0-100%) as is the amount of image data. The weight of the toner deposited on recording medium P per 1 $cm^2$ of recording medium P is referred to as the amount of toner deposition. When the amount of toner of a monochromatic image is 100%, the monochromatic image is highest in density.

The processing conditions, such as development conditions, are set so that the relationship between the amount of toner (0-100%) and the image density (0-100%) becomes linear, based on this maximum image density.

The maximum density is affected by various factors, such as the toner properties, fixation conditions set for the fixing apparatus (fixing device), and type of recording medium. It is also affected by image design, such as the maximum density set for each monochromatic color toner image.

In this embodiment, the process speed is 100 mm/sec. The control temperature levels (target temperature levels) for the fixation roller 51 and pressure roller 52 are both 160° C.

When the image forming apparatus in this embodiment is operated under the above-mentioned conditions, using a gloss coat paper of A2 size, which is 80g/$m^2$ in basis weight; with the amount of toner deposition set to 0.5 mg/$cm^2$, the density levels for all colors were 1.8. This amount of toner deposition, or 0.5 mg/$cm^2$, was used as the maximum amount of toner deposition for of each color toner.

Based on the above-described data, the amount of toner for each picture element is calculated, and corrective processes, such as the so-called gamma correction, are carried out, to ensure that the tone of each monochromatic color toner image, which will be outputted, will match the amount of data for the monochromatic color toner image. Then, the monochromatic toner images, different in color, are sequentially formed, and are placed in layers to display various colors. Theoretically, therefore, the maximum amount of image data of the information regarding a full-color image is 400%. Further, to this amount of image data, the pictorial information of an image to be formed of clear toner, the maximum amount of data of which is 100%, is added.

The amount of toner deposition for a clear toner image is not set for achieving a specific density level, but, for achieving a preset level of glossiness. When an image was formed on an A2 sheet of gloss coat paper, which is 150 g/$m^2$ in basis weight, with the use of clear toner, with the amount of toner deposition set to 0.5 mg/$cm^2$, the glossiness level of the resultant image was 60% (60 degree glossiness measurement). The glossiness level was measured with the use of a portable gloss meter (PG-1M), product of Nippon Denshoku Industries Co., Ltd.) (based on JIS Z 8741 "mirror surface glossiness level measuring method").

The maximum amount of clear toner deposition does not need to be equal to the maximum amount of color toner deposition. That is, the amount of clear toner deposition, which can provide a preset level of glossiness may be referred to as the maximum amount of clear toner deposition.

As described above, the theoretical maximum amount of image data of the color image information is 400%. In reality, however, it does not occur that toner is used by the amount which corresponds to 400%. That is, methods such as UCR, GCR, etc., which will be described next, are used so that the maximum amount of image data for a color image falls in a range of 180%-240%.

UCR stands for "Under Color Removal". To describe more concretely, when a full-color image is synthetically formed of four monochromatic images, that is, cyan, magenta, yellow, and black monochromatic images, the areas of the recording medium P, across which all of the cyan, magenta, and yellow toners are deposited in layers appear gray, unless correction is made. UCR is one of the methods for making a correction so that the areas, which would have appeared gray (gray component is generated), will appear black (will be replaced with black component). In other words, the object of UCR is to reduce the total amount of image data by replacing the above-described gray component, which is higher in density than a preset level, with black component.

GCR stands for "Grey Component Replacement). If the amounts of the C (cyan), M (magenta), and Y (yellow) toners deposited on a given point of a full-color image synthetically formed by color separation are the same in ratio, this point appears black or gray. By replacing this point with K (black) point, it is possible to reduce the image in dot ratio; the image can be reduced in the total ratio of the areas covered with toner dots.

In this embodiment, the above-described methods are used so that the total amount of toner, that is, the sum of the amount of color toners and the amount of clear toner, become 210% (1.05 mg/$cm^2$).

Incidentally, regarding the performance of a fixing apparatus, the fixing apparatus F in this embodiment is designed so that even when the amount of toner is 210% (1.05 mg/$cm^2$), it can properly fix the toner image(s).

(4) Clear Toner Usage Mode

The clear toner usage mode is an image formation mode for forming an image on recording medium with the use of both color toners and clear (transparent) toner.

In the clear toner usage mode, not only are four color toner images formed by the first to fourth image forming portions Pa, Pb, Pc, and Pd, one for one, but also, a clear toner image is formed by the fifth image forming portion Pe.

When the image forming apparatus in this embodiment is used as a printer, the external host apparatus 1,000, such as a personal computer, is used in combination with imaging software capable of handling a clear toner image, to form a desired image. Then, the created image data are converted into the image information of each of the CMYK (cyan, magenta, yellow, and black monochromatic images) +clear toner image, in the RIP (Raster Image Processor). After being converted into pictorial information regarding the above-mentioned four monochromatic color toner images and clear toner image, the image data are converted by a printer driver, into such pictorial information that is compatible with the outputting device of the image forming apparatus, and then, is sent in the form of an electric signal to the image forming apparatus main assembly.

When the image forming apparatus is in the clear toner usage mode, a desired image is formed in two stages, that is, first and second stages, each of which is made up of its own image forming process and image fixing process. That is, first, an image is formed on recording medium with the use of color toners, and fixed, through the first stage. Then, another image is formed on the recording medium with the use of color toner and clear toner, in a manner to be laid on the fixed color toner images on the recording medium, and fixed, through the second stage.

That is, the image forming apparatus in this embodiment is structured so that when it is used to form a full-color image on recording medium with the use of color toners and transparent toner, a mode in which the combination of the process of forming toner images on recording medium and the process of fixing the images, are carried out multiple times (twice in this embodiment) to yield a final image, can be selected.

Further, the image forming apparatus in this embodiment is structured so that when fixing the unfixed clear toner image, at least one of the unfixed color toner images can be fixed along with the unfixed clear toner image. Structuring the image forming apparatus as described above makes it possible to prevent the problem that during the fixing process (final fixing process) in the second stage of the image forming operation, a part or parts of the color toner images which have been fixed during the fixing process in the first stage of the image forming operation (areas of color toner images, which have not been covered with clear toner), becomes defective (unsatisfactory in quality).

In this case, the amount of image data for the color images to be formed on the recording medium during the first stage (made up of image forming and fixing processes) of the image forming operation, can be changed by the controller K according to the sum of the amount of data for the color toner images and the amount of data for the clear toner image.

As will be described later, if the amount of image data (amount of toner deposition) is no more than a preset value, a mode in which a desired toner image is formed on recording medium through a single stage, that is, the first stage (made up of image forming and fixing processes) of the image forming operation, instead of multiple stages (two stages in this embodiment), is selected by the controller K, which also functions as a mode switching means.

In other words, if the amount of image data per picture element (which corresponds to amount of toner deposition per unit area) is no less than a preset value, a mode in which a desired toner image is formed on recording medium in multiple stages (each of which is made up of image forming and fixing processes), which in this embodiment are the first and second stages of the image forming operation, is selected by the controller K. In this case, the amount of image data is calculated for every picture element.

That is, this embodiment is characterized in that the controller K determines whether or not a desired toner image is to be formed in multiple stages (two stage in this embodiment), each of which is made up of image forming and fixing processes, according to the information regarding the maximum amount of toner deposition, and then, selects the suitable mode based of the determination.

More concretely, if the controller K determines that the maximum total amount of toner deposition per unit area of the image formation area of recording medium, which is to be covered with clear toner, is no more than a preset value, the controller K selects the mode in which a desired toner image is formed on recording medium in a single stage, which is made up of the image forming and fixing processes.

If the controller K determines that the maximum total amount of toner deposition per unit area of the image formation area of the recording medium, which is to be covered with clear toner, is no less than a preset value, the controller K selects the mode in which the portion of a desired image, across which a transparent toner image is to be formed, is formed in multiple stages (which in this embodiment is two stages), each of which is made up of the image forming and fixing processes, whereas the portion of the desired image, which is to be formed of only the color toners, is formed in a single stage, that is, the final stage.

When the maximum total amount of toner deposition per unit area of the area of the recording medium, which is to be covered with clear toner, is no less than a preset value, the controller K controls the image forming apparatus in the following manner. That is, in order to prevent the fixed toner image(s) from coming into contact with the fixing means for the second time, the operation for forming toner images with the use of color toners is carried out in two separate stages, each of which is made up of the image forming and fixing processes.

Figure 6:
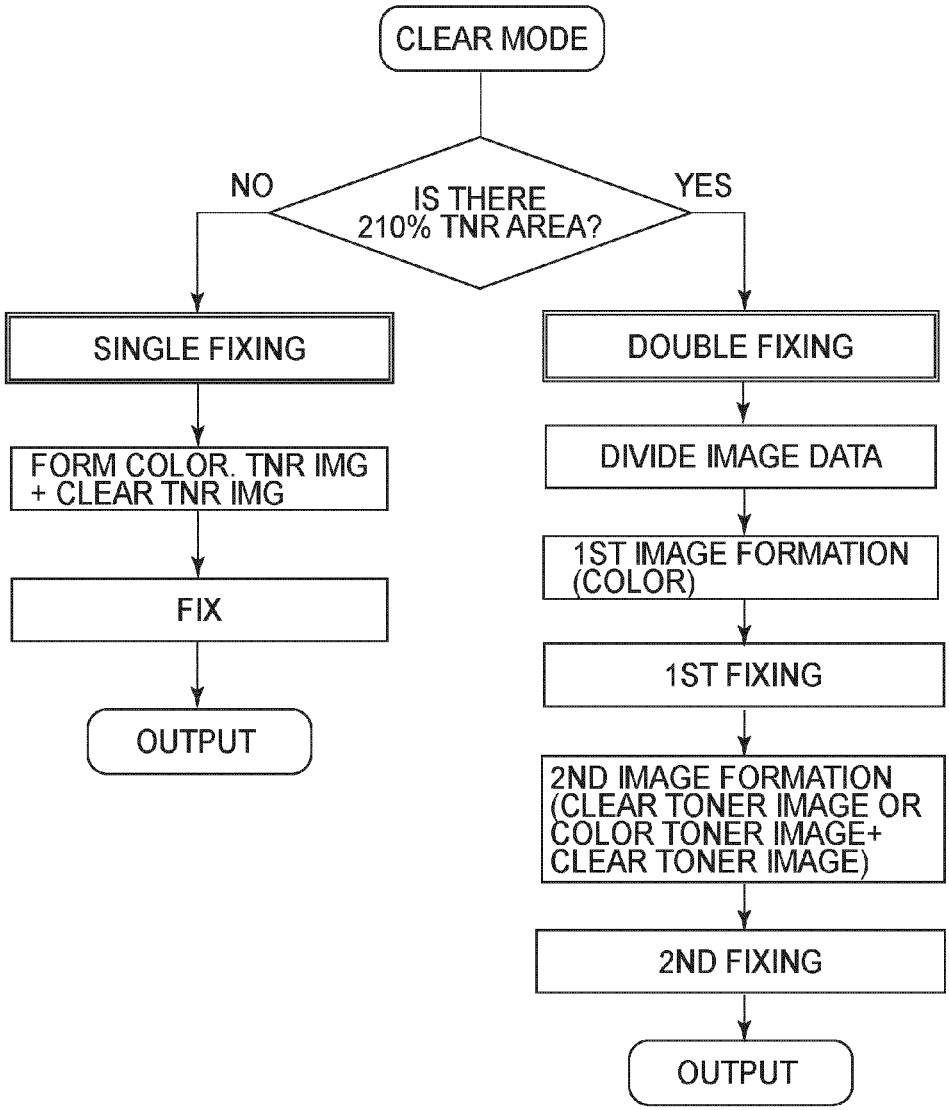
FIG. 6 is a flowchart of the operational sequence of the image forming apparatus in the clear toner usage mode, in the first embodiment.

FIG. 6 is a flowchart of the control sequence in the clear toner usage mode in this embodiment.

In this embodiment, the controller K calculates the sum of the amount by which color toners are to be deposited on the area of recording medium P, across which a clear toner image is to be formed, and the amount by which clear toner is to be deposited on the same area, based on the electrical image information received from the external host apparatus through the interface portion.

More concretely, in this embodiment, the controller K determines whether or not there will be picture elements, the amount of toner deposition of which is no less than 210%. That is, the controller K determines whether or not an intended image has areas, across which a clear toner image is to be formed, and which are no less than 210% in the maximum total amount of toner deposition.

When there are no picture elements which are greater than 210% in the amount of toner deposition, "all-at-once fixation mode" is selected and carried out. When their picture elements which are no less than 210% in the amount of toner deposition, "twice fixation mode" is selected and carried out.

Regarding the proportioning of toner, the amount by which toner is to be deposited is calculated for all picture elements, using the following equation (Equation (1)).

$$Dc = At - B\max \quad (1)$$

Dc: amount (%) of color toner to be used (deposited) per picture element in first stage of image formation, At: total amount (%) of toner used (deposited) per picture element, Bmax: threshold value for amount (%) of toner.

In this embodiment, Bmax is 210%, and the maximum value of At is 310%. Thus, the maximum value of Dc is 100%.

In this embodiment, when forming a clear toner image, whether "all-at-once fixation mode" or "twice fixation mode" is to be selected is determined, regardless of whether the entirety of the image formation area of recording medium is to be covered, or a clear toner image is formed as an inconspicuous marking.

If it is determined that "twice fixation mode" is to be selected, images are formed using color toners by the amount D (%) during the first stage of the image forming operation, and the rest of toners is used during the second stage.

In other words, in this embodiment, whether "all-at-once fixation mode" or "twice fixation mode" is to be selected is determined based on the maximum amount of toner deposition per unit area of the area of recording medium across which a clear toner image is to be formed, as described above. Therefore, the length of time necessary for image formation is minimized. That is, the length of time necessary to carry out an image forming operation in which both color toners and clear toner are used is minimized while preventing unsatisfactory fixation.

In an "all at once fixation mode", color toners are not proportioned in advance in usage. That is, all color toners and all clear toner are used all at once to form an image on recording medium. Then, the combination of the color toner images and clear toner image are fixed all at once to yield a glossy print (copy), or a print having an inconspicuous marking or markings.

In a "twice fixation mode", the image forming operation for forming an image on recording medium is carried out in two stages, each of which is made up of its own image forming process and image fixing process. In this mode, it is possible to change the amount by which color toners are deposited on the recording medium in the first stage of the image forming operation, to yield a glossy print (copy) or a print having an inconspicuous marking or markings.

More specifically, in the "twice fixation mode", the controller K proportions the amount of color toners, which is calculated based on the color image data, into two data, that is, the data for the first stage of the image forming operation, and the data for the second stage of the image forming operation. That is, the controller K changes the amount by which color toners are to be deposited in layers onto recording medium in the first stage of the image forming operation, based on the inputted electrical image information and the total amount of toner. Because of this change in the amount of toner (proportioning of color toners), it is possible that when a desired image is formed on the recording medium in two stages, color toner images will be included as the toner images to be fixed in the fixing process in the second stage of the image forming operation, in addition to the clear toner image.

First, the first stage (first process for forming first color toner images) of the image forming operation is carried out on recording medium, with the use of color toners (first color toners), based on the data regarding the amount of toner to be used for the first stage of image forming operation. Then, the process (first process) for fixing the color toner images, is carried out.

Then, an image is formed on the fixed color toner images, with the use of clear toner, or color toner images and clear toner image are sequentially formed on the fixed color toner images, with the use of color toners (second portions of color toners) and clear toner, respectively, based on the data regarding the amount of the toner for the second stage of the image forming operation. That is, the second image formation process (which is made up of process for forming color toner images, with the use of second color toners, and process (third image formation process) for forming clear toner image) is carried out on the surface of the recording medium to which the first color toner images have just been fixed. Then, the second fixation process, that is, the fixation process for fixing the final image, which includes the clear toner image, is carried out. Incidentally, depending upon on the data regarding the amount of toner, it is possible that Y, M, C, and K toner images will be formed and fixed in the first stage of the image forming operation, and then, a clear toner image will be formed and fixed in the second stage of the image forming operation.

In other words, in this embodiment, a final print (copy), which is a glossy print (copy), or a print with an inconspicuous marking or markings, is outputted by carrying out the image forming operation in sequential two stages, that is, first and second stages, each of which is made up of its own image forming process and image fixing process.

More concretely, in the "twice fixation mode", first, toner images are formed on the recording medium P in the first to fourth image forming portions Pa, Pb, Pc, and Pd with the use of color toners (first image formation process). Then, the recording medium P is introduced into the fixing apparatus F, in which the color toner images are fixed (first fixation process). After coming out of the fixing apparatus F, the recording medium P, which has just gone through the first image formation process and first fixation process, is directed toward the turning-and-refeeding system G by the selector 13, which has been flipped into its second position outlined by the double-dot chain line in FIG. 5. Then, the recording medium P enters the turning-and-refeeding system G, is conveyed through the conveyance path 26 without being turned over, and reaches the pair of registration rollers 9. Then, it is conveyed again onto the transfer belt 7 with a preset timing. Meanwhile, a clear toner image is formed in the fifth image forming portion Pe, or color toner images are formed in the first to fourth image forming portions Pa, Pb, Pc, and Pd and a clear toner image is formed in the fifth image forming portion Pe. As a result, a clear toner image, or a combination of color toner images and clear toner image (second image formation process), is formed on the fixed color toner images formed on the recording medium in the first stage of the image forming operation. Then, the recording medium P is introduced again into the fixing apparatus F, in which the unfixed toner images formed in the second image formation process are fixed (second fixation process). After the recording medium P is conveyed through the fixation nip N of the fixing apparatus F for the second time, it is discharged from the fixing apparatus F by the fixation discharge rollers 56 and is conveyed further by the fixation discharge rollers 56. Then, when the image forming apparatus is in the single-sided image formation mode, the recording medium P is moved on the top side of the selector 13, which has been switched in position, that is, moved back into its first position outlined by the solid line in FIG. 5, is relayed by the discharge rollers 14 of the apparatus main assembly, and is discharged into the external delivery tray 19 through the opening of the recording medium outlet 15.

Regarding the control for turning over the recording medium P by conveying the recording medium P through the turning-and-refeeding system G, the flapper 21 is switched in position to allow the recording medium P to be directly conveyed to the conveyance path 26, or to cause the recording medium P to be conveyed to the conveyance path 26 by way of the recording medium turning path 20.

In a case where an image is partially covered (marked) with clear toner as described above, it is possible that the portions of fixed color images, which are not covered with clear toner will degrade in appearance. This phenomenon does not occur to the areas covered with clear toner. The unsatisfactory appearance, in this case, means nonuniformity in glossiness, which makes the fixed image appear grainy, that is, appear as if the surface of the fixed image were covered with grainy substances which are 0.1-3 mm in size.

It was found out that this phenomenon occurred because a small amount of air having entered the fixation nip N was trapped between the fixation roller and toner images, preventing thereby the portions of the surface of the toner images, which corresponded in position to the trapped air, from coming into contact with the fixation roller.

More specifically, when an unfixed toner image is fixed, the trapped air is allowed to escape through the gaps among the unfixed toner particles. However, in the "twice fixation mode", an unfixed toner image is smoothed across its surface during the first fixation process, preventing thereby the trapped air from escaping through the gaps among the toner particles of the toner image. This is thought to be why the aforementioned image degradation occurred in the "twice fixation mode".

On the other hand, if the "twice fixation mode" is carried out as described above, the areas of the color toner images, which were formed and fixed in the first stage of an image forming operation, are covered with unfixed toner in the toner image formation process of the second stage of the image forming operation. Therefore, the trapped air is allowed to escape through the gaps among the toner particles of the unfixed toner image formed by the toner image forming process of the second stage of the image forming operation. Therefore, the above-described image degradation does not occur.

In the above-described case, that is, in the "twice fixation mode", the process of proportioning toners between the first and second stages of the image forming operation (which are made up of image formation process and fixation process) is carried out for each of the color toners (Y, M, C, and K). In this embodiment, however, instead of employing such a toner proportioning method that uses the entirety of Y (yellow) toner and a part of M (magenta) toner in the first stage of the image forming operation, and the rest of M (magenta) toner and the entireties of C (cyan) and K (black) toners in the second stage of the image forming operation, a method that uses Y and M toners in the first stage of the image forming operation, and C and K toners in the second stage of the image forming operation is employed for the following reason. That is, if each color toner is proportioned between the first and second stages of the image forming operation, the halftone areas of each monochromatic color toner image are formed in two stages, which creates another problem, that is, the problem that the image forming apparatus becomes unstable in image density and tone.

Further, in an electrophotographic image forming method, image density is changed by area coverage modulation. Therefore, should the image formed in the second stage of the image forming operation fail to be laid on a specific area of the image formed in the first stage of the image forming operation, onto which the image formed in the second stage of the image forming operation is to be layered, it is possible that the resultant image will be significantly different in the size of the area to be covered with toners, being therefore significantly different in image density and tone, from the intended image.

In the above discussion, the embodiment was described with reference to the formation of the yellow toner image. Needless to say, the toners used in the embodiment, and the order in which the color toner images and clear toner image are formed in the embodiment are not intended to limit the present invention is scope; it is desired that they do not limit the present invention in scope.

In the embodiment described above, not only the images, whose picture elements satisfies an inequity ($Dc \geqq 0$), are formed in the first stage of the image forming operation, but also, the entirety of the yellow monochromatic toner image is formed in the first stage of the image forming operation. Incidentally, the image forming apparatus in this embodiment forms the Y, M, C, and K toner images in the listed order.

However, this method suffers from the following problem. That is, if the toners to used in the second stage of the image forming operation are not laid, in the second stage of the image forming operation, on preset areas of the yellow toner image formed and fixed in the first stage of the image forming operation, this area of the yellow toner image is subjected to thermal energy in the fixation process in the second stage of the image forming operation, making it possible for the area to be degraded.

Therefore, whether or not yellow toner is available for the second stage of the image forming operation is calculated for all the picture elements of the yellow monochromatic image to be made. If no area of the yellow monochromatic toner image to be made needs to be formed in the second stage of the image forming operation, it is desired to employ the above-described toner proportioning method, that is, the method which forms the entirety of yellow monochromatic toner image in the first stage of the image forming operation. The merit of this method is that no area of the yellow monochromatic toner image suffers from toner deviation and/or density deviation.

On the other hand, if yellow toner is available for the second stage of the image forming operation, that is, if there are image areas to be formed of yellow toner in the second stage of the image forming operation, it is preferred that the toner proportioning method, which will be described next, is employed.

That is, if the value of Dc, which is calculated by Equation (1) is equal to, or greater than 0 ($Dc \geqq 0$), and therefore, it is determined that it is necessary to select the "twice fixation mode", it is desired that the image forming operation is carried out in two stages, each of which is made up of its own image formation process and image fixation process, in order to prevent the fixed toner images from coming into contact with the thermal rollers of the fixing device for the second time.

Incidentally, even if $Dc \geqq 0$ (from Equation (1)), and therefore, it is determined that it is necessary to select the "twice fixation mode", only the areas of the image to be formed, which are to be covered with clear toner, may be formed in two stages as described above. That is, for the purpose of preventing the fixed toner images from coming into contact with the thermal rollers of the fixing device, it is preferred that the areas of the image to be formed, which are to be formed with the use of only color toners, are fixed in entirety in the second fixation process (final fixation process). The employment of the toner proportioning method described above makes it possible to prevent the problem that the image formed of yellow toner is subjected to an excessive amount of heat, which results in the degradation of the yellow toner image.

Further, in this embodiment, the threshold value used to determine whether or not each color toner is to be separated into two portions, that is, one for the first stage of the image forming operation and the other for the second stage of the image forming operation, was 210%. However, the threshold value does not need to be 210%.

As described above, this embodiment of the present invention makes it possible to provide an image forming apparatus which can yield a glossy image, the glossiness level of which is at a desired level, with the use of color toners and clear toner, without causing the areas of the glossy image, which have been covered with the fixed color toners, to degrade.

That is, in this embodiment, an image forming operation for forming a toner image on recording medium with the use of color toners and clear toner is carried out in two stages, each of which is made up of its own image formation process and image fixation process, in order to prevent the problem that an unsatisfactory image is yielded due to the improper amount of thermal energy which recording medium and toner image(s) thereon receive during the fixation process. Also in this embodiment, whether an image forming operation for forming a toner image on recording is to be carried out in two stages or single stage is determined for each color toner, preventing thereby the formation of a glossy full-color image which is unsatisfactory in density and/or deviant in tone.

Embodiment 2

In this embodiment, the settings for image fixation are changed based on whether (a) the entirety of a full-color image is covered with clear toner to yield an image which is uniformly glossy in entirety, or (b) a full-color image is partially covered with clear toner to provide the image with inconspicuous marking or the like. That is, in the case (a), the portion of the recording medium, across which an image is to be formed, is entirely covered with clear toner. In the case (b), the portion of the recording medium, across which an image is to be formed, is partially covered with clear toner. The image forming apparatus used in this embodiment is the same as the one used in the first embodiment, except for its control.

Normally, in electrophotography, the surface of recording medium does not change in glossiness, and the glossiness of the portion of recording medium covered with toner is affected by the change in toner density. Thus, if a certain type of image is formed on recording medium, the resultant print (copy) becomes nonuniform in glossiness, being therefore lower in quality. This problem can be solved by covering the entirety of the image formation area of the recording medium with clear toner; a print (copy) which is uniformly glossy across its entire image formation area can be yielded by covering the entirety of the image formation area of recording medium with clear toner before fixation.

However, covering entirely the image formation area of recording medium increases the amount of data regarding the toner image to be fixed. Therefore, if the color toners are insufficiently fixed, not only are the toners likely to peel from recording medium after a final print (copy) is outputted, but also, a print (copy) which is slightly lower in glossiness level than expected is likely to be outputted.

Entirely covering the image formation area of recording medium with clear toner can prevent the problem that the color toner images having been fixed during the first stage of the image forming operation (twice fixation mode) are degraded during the second stage of the image forming operation.

Thus, for the purpose of solving the above-described problem, the image forming apparatus in this embodiment is designed so that when the apparatus is operated in the mode in which the image formation area of recording medium is entirely covered with clear toner after the completion of the first state of the image forming operation, its fixing apparatus is increased in performance, whereas when the apparatus is operated in the mode in which the image formation area of recording medium is only partially covered with clear toner for the purpose of forming an inconspicuous marking or the like, its fixing apparatus is kept normal in performance. This arrangement solved the above-described problem.

More specifically, "increasing the fixing apparatus in performance" means to increase the fixing apparatus in fixation temperature level, to decrease it in fixation speed, and/or to increase it in the fixation nip pressure, in order to increase the amount of energy to be given to recording medium and the toners thereon.

Increasing the fixing apparatus in performance with the use of methods, such as the above-described ones, has side effects, such as increase in energy consumption, reduction in output (print count) per unit length of time, etc. This is why it is preferred that when the image forming apparatus is in the mode in which clear toner is used only for forming an inconspicuous marking or the like, the setting of the fixing apparatus is returned to the normal.

In the experiments carried to test this embodiment, clear toner is applied across certain areas of recording medium to form inconspicuous images, such as a company logo, a company name and a brand name. However, the image to be formed with the use of clear toner does not need to be limited to those mentioned above. For example, it may be a photographic image to be formed across a part of an intended image.

The controller K determines, based on the inputted electrical image (picture) information, whether or not clear toner is to be applied to only a specific area (areas) or entirety of the image formation area of recording medium. More concretely, it determines whether or not the data for each picture element includes both color toner data and clear toner data. If there are picture elements which have only color toner data, the controller K determines that clear toner is to be deposited on only a specific area (areas) of recording medium to form an inconspicuous marking or the like, setting therefore the image forming apparatus accordingly, whereas if there are no picture elements which have only color toner data, the controller K determines that clear toner is to be deposited across the entirely of the image formation area of recording medium, setting therefore the image forming apparatus accordingly.

Figure 7:
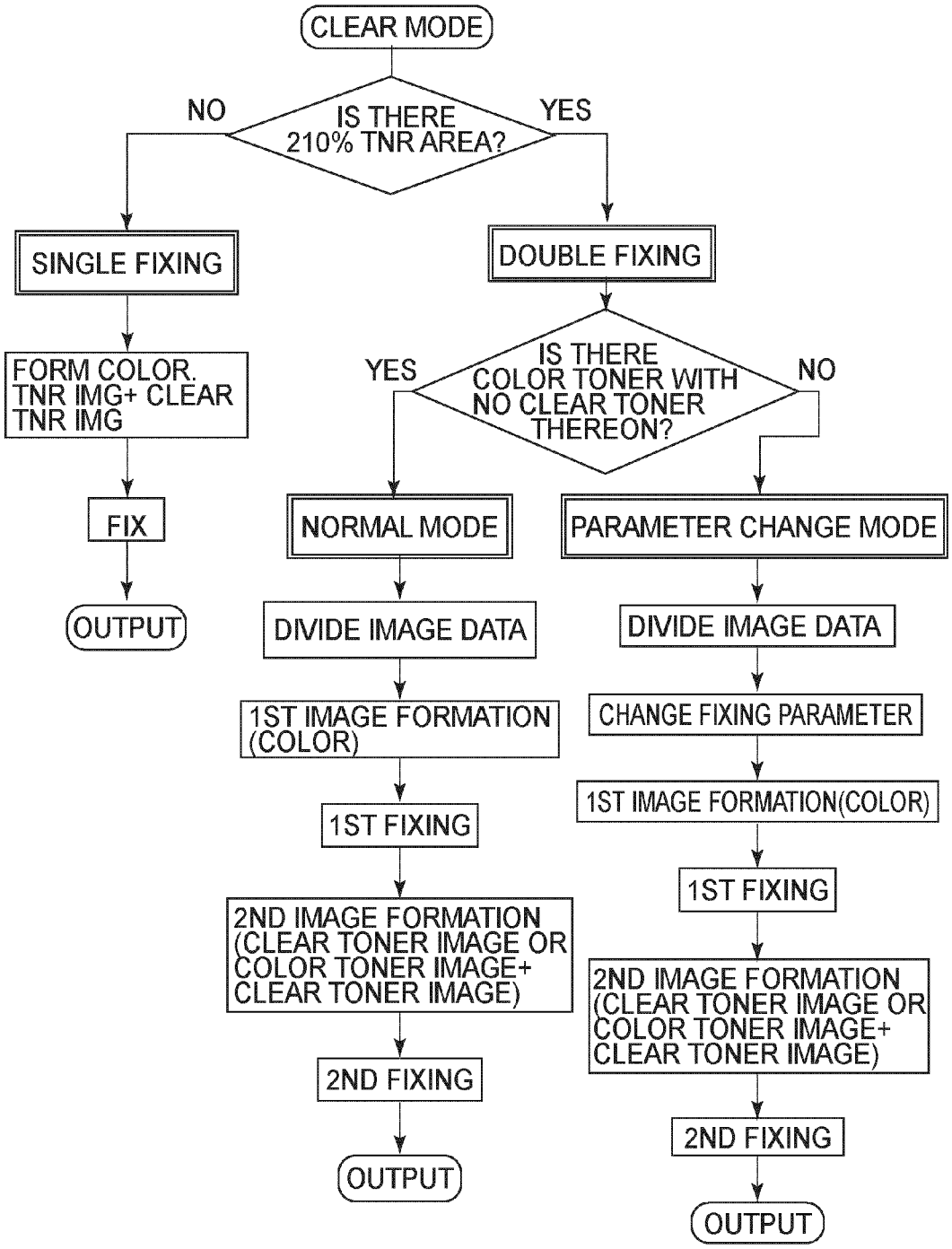
FIG. 7 is a flowchart of the operational sequence of the image forming apparatus in the clear toner usage mode in the second embodiment.

FIG. 7 is a flowchart of the control sequence in the clear toner usage mode in this embodiment. The controller K computes the total amount of toners, that is, the sum of the amount of color toners and amount of clear toner, which are to be used for the formation of a toner image to be formed on recording medium, based on the electrical information of the image, which is inputted from the external host apparatus, as it did in the first embodiment. Then, it determines whether or not there are picture elements whose total amount of toner deposition exceeds 210%. If it determines that there are no picture elements whose total amount of toner deposition exceeds 210%, it carries out the "all at once fixation mode". If it determines that there are picture elements whose total amount of toner deposition exceeds 210%, it carries out the "twice fixation mode". In this embodiment, the setting of the fixing apparatus F in the "all at once fixation mode" is the "normal setting".

As the controller K switches the operational mode of the image forming apparatus to the "twice fixation mode", it determines whether or not there are picture elements which are to be formed of only color toners. If there are, the image forming operation to be carried out is the image forming operation in which clear toner is deposited on a specific area or areas of recording medium to form inconspicuous markings or the like. If there are no picture elements which are to be formed of only color toners, the image forming operation to be carried out is the image forming operation in which clear toner is deposited across the entirety of the image forming area of recording medium to yield a copy which is uniformly glossy in entirety. In the former case, the "normal mode" is selected. In the latter case, the "fixation condition change mode" is selected.

In the image forming operation in which clear toner is to be deposited across the entirety of the image formation area of recording medium, clear toner may be evenly deposited across the entirety of the image formation area of the recording medium, or the amount by which clear toner is deposited on a give area of the image formation area of recording medium may be adjusted so that the image formation areas of recording medium becomes uniform in the total amount of toners deposited thereon.

When the image forming apparatus is in the "normal fixation mode", the "twice fixation mode" is carried out, with the fixing apparatus F set to the "normal setting".

When the image forming apparatus is in the "fixation condition change mode", the image data is proportioned. Then, the fixing apparatus F is changed in fixation condition, and the "twice fixation mode" is carried out under the changed fixation condition. The fixation condition of the fixing apparatus F is changed so that the energy to be provided for fixation is increased by a preset amount relative to the normal setting. More concretely, the fixing apparatus F is reduced in the fixation speed slower, is increased in fixation temperature, and/or is increased in fixation roller pressure.

For example, the normal setting of the fixation speed is 100 mm/sec. However, when the image forming apparatus in the "twice fixation mode", and the entirety of the image formation area of recording medium is to be covered with clear toner, the fixation speed is changed to 80 mm/sec.

With the above described change in the fixation condition, the image forming apparatus yielded an image (glossy image) which is more uniform in glossiness.

Incidentally, the "normal setting" for fixation temperature is 160° C. Thus, when clear toner is to be deposited across the entirety of the image formation area of recording medium in the "twice fixation mode," the fixation temperature level of the fixing apparatus F may be set to 180° C.

The level of glossiness, which clear toner can provides, is affected by the fixation condition. Therefore, if a user (operator) wants to adjust an image forming apparatus (fixing apparatus) to yield an image with a desired level of glossiness, that is, an image which is higher in glossiness level, or an image which is not too glossy, it is desired that the fixation speed, fixation temperature level, and fixation roller pressure are more finely set.

As described above, this embodiment of the present invention also made it possible to provide an image forming apparatus which can yield a glossy image, the glossiness level of which is at a desired level, with the use of color toners and clear toner, without causing the areas of the glossy image, which have been covered with the fixed color toners, to degrade.

The usage of the clear toner usage mode, such as those in the first and second embodiment, does not need to be limited to the usage in combination with the single-sided image formation mode. That is, the clear toner usage mode can be used when an image is formed on the second surface of recording medium in the two-sided image formation mode. Further, the usage of the clear toner usage mode does not need to be limited to the usage in combination with the full-color image formation mode. That is, the clear toner usage mode can also be used in combination with the chromatic image formation mode as well as the black-and-white image formation mode.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 147972/2007 filed Jun. 4, 2007 which is hereby incorporated by reference.

What is claimed is:

1. An image forming apparatus comprising:

an image forming device configured to form a toner image on a sheet with non-transparent toner and transparent toner;

a fixing device configured to fix, on the sheet, the toner image formed by said image forming device; and obtaining means for obtaining a total amount of the non-transparent toner and the transparent toner on a sheet; and control means for controlling, in an operation in a mode in which both of the non-transparent toner and the transparent toner are provided on the sheet, such that only one step of transferring and fixing the transparent toner and the non-transparent toner on the sheet is effected when the total amount of the transparent toner and the non-transparent toner on the sheet is smaller than a predetermined amount, and the step of transferring and fixing the transparent toner and the non-transparent toner on the sheet is effected twice for one sheet using the same fixing device when the total amount of the transparent toner and the non-transparent toner on the sheet is larger than a predetermined amount.

2. An apparatus according to claim 1, wherein when the plurality of image forming and fixing steps are carried out, the transparent toner image is formed on the non-transparent toner image.

3. An apparatus according to claim 1, wherein said control means controls, in an operation in a mode in which only the non-transparent toner is provided on the sheet, such that only one step of heating the toner fixed by said fixing means is always effected on the sheet.

* * * * *